US008631630B2

(12) United States Patent
Naaber

(10) Patent No.: US 8,631,630 B2
(45) Date of Patent: Jan. 21, 2014

(54) CLOSURE HEAD FOR CONTAINER CLOSURE MACHINES AND CONTAINER CLOSURE MACHINE

(75) Inventor: Matthias Naaber, Bretzenheim (DE)

(73) Assignee: KHS GmbH, Dortmund (DE)

( * ) Notice: Subject to any disclaimer, the term of this patent is extended or adjusted under 35 U.S.C. 154(b) by 338 days.

(21) Appl. No.: 13/129,865

(22) PCT Filed: Dec. 15, 2009

(86) PCT No.: PCT/EP2009/008957

§ 371 (c)(1),
(2), (4) Date: May 18, 2011

(87) PCT Pub. No.: WO2010/081518

PCT Pub. Date: Jul. 22, 2010

(65) Prior Publication Data

US 2011/0225928 A1 Sep. 22, 2011

(30) Foreign Application Priority Data

Jan. 15, 2009 (DE) ..... 10 2009 005 150

(51) Int. Cl.
*B65B 7/00* (2006.01)

(52) U.S. Cl.
USPC ..... 53/329; 53/317; 53/281; 53/478

(58) Field of Classification Search
USPC ..... 53/317, 324, 329, 330, 331.5, 334, 281, 53/287, 478, 485
See application file for complete search history.

(56) References Cited

U.S. PATENT DOCUMENTS

| | | | | |
|---|---|---|---|---|
| 1,773,259 | A | 8/1930 | Cundall | |
| 1,773,960 | A | 8/1930 | Cundall | |
| 2,076,631 | A | 4/1937 | Gantzer | |
| 3,984,965 | A | 10/1976 | Crisci | |
| 6,044,626 | A | 4/2000 | Harper et al. | |
| 7,131,245 | B2 * | 11/2006 | Joerg et al. | 53/317 |
| 7,322,165 | B2 * | 1/2008 | Spether | 53/331.5 |
| 7,765,772 | B2 * | 8/2010 | DeLuca et al. | 53/317 |
| 7,874,127 | B2 * | 1/2011 | Brown | 53/317 |
| 7,882,682 | B2 * | 2/2011 | Martin | 53/317 |
| 8,166,730 | B2 * | 5/2012 | Schmatz | 53/331.5 |
| 8,220,225 | B1 * | 7/2012 | Zemlin | 53/331.5 |
| 2004/0187441 | A1 * | 9/2004 | Cirio | 53/432 |
| 2007/0084152 | A1 * | 4/2007 | Brown | 53/490 |
| 2007/0261369 | A1 * | 11/2007 | Takahara et al. | 53/317 |

FOREIGN PATENT DOCUMENTS

| | | |
|---|---|---|
| DE | 102004048782 | 4/2006 |
| WO | WO2004/009484 A1 | 1/2004 |

* cited by examiner

*Primary Examiner* — Hemant M Desai
(74) *Attorney, Agent, or Firm* — Occhiuti & Rohlicek LLP

(57) ABSTRACT

The invention relates to a closure head for container closure machines (1) for closing bottles or similar containers with closures, having a head part, having a receptacle formed on a head part and open on the bottom of the closure head and the head part for one closure each, wherein the receptacle forms at least one radial and at least one axial contact surface relative to an axis of the receptacle for the closure received in the receptacle, and wherein the radial contact surface for at least force-fit retaining of the closure in the receptacle is formed of at least one displaceable segment displaceable at least radially to the axis of the receptacle at least in the area of the radial contact surface.

19 Claims, 4 Drawing Sheets

CLOSURE HEAD FOR CONTAINER CLOSURE MACHINES AND CONTAINER CLOSURE MACHINE

This application is the National Stage of International Application No. PCT/EP2009/008957, filed on Dec. 15, 2009, which claims the priority of German Patent Application No. 10 2009 005 150.3, filed on Jan. 15, 2009. The contents of both applications are hereby incorporated by reference in their entirety.

FIELD OF DISCLOSURE

The invention relates to a closure head for use on container closure machines for closing bottles or similar containers with closures, for example with screw caps, according to the preamble of claim 1. The invention furthermore relates to a container closure machine for closing bottles or similar containers with such closures according to the preamble of claim 15.

BACKGROUND

Container closure machines for closing bottles or other containers are known in various embodiments. In particular container closure machines are known for closing bottles or other containers with screw caps. These caps are applied to the containers by screwing onto an external thread provided in the area of the container opening concerned, namely by screwing with a closure tool which is equipped with a closure head forming a receptacle for the respective closure. In detail, the container concerned is closed such that the respective cap is first held in the receptacle of the closure head. Then the cap held in the closure head at least by force-fit i.e. by clamping, is placed on the container opening and then screwed onto the respective container by the closure head driven rotationally about a closure head axis or receptacle axis. A force-fit connection does not exclude the provision of grooving and/or fluting which allows at least a partial form fit by interlocking of opposing surface contours.

SUMMARY

During the screwing, the container lies pressed against the closure head or against the cap held in the closure head axially i.e. in the direction of the axis of the receptacle with a certain force, for example with a force of 20 kp or around 200N.

For reliable and adequately tight closure of the containers it is necessary for the respective container closure to be screwed sufficiently firmly i.e. with a sufficiently high torque onto the container to be closed, irrespective of any tolerances which container closures normally have, in particular in relation to the effective external diameter, which can greatly detract from the force fit connection or clamp fixing of the container closure in the closure head.

The object of the invention is to produce a closure head which even with greater tolerances of the container closures guarantees reliable closing of bottles or similar containers. To achieve this object a closure head is formed according to claim 1. A container closure machine is the object of claim 15.

Refinements, benefits and possible applications of the invention arise from the description below of embodiment examples and from the figures. All features described and/or shown in the figures, alone or in any combination, in principle belong to the object of the invention irrespective of their summary in the claims or any back reference. The content of the claims is also declared a constituent part of the description.

BRIEF DESCRIPTION OF THE FIGURES

The invention is explained below with reference to the figures and one embodiment example. These show.

DETAILED DESCRIPTION

Figure 1:
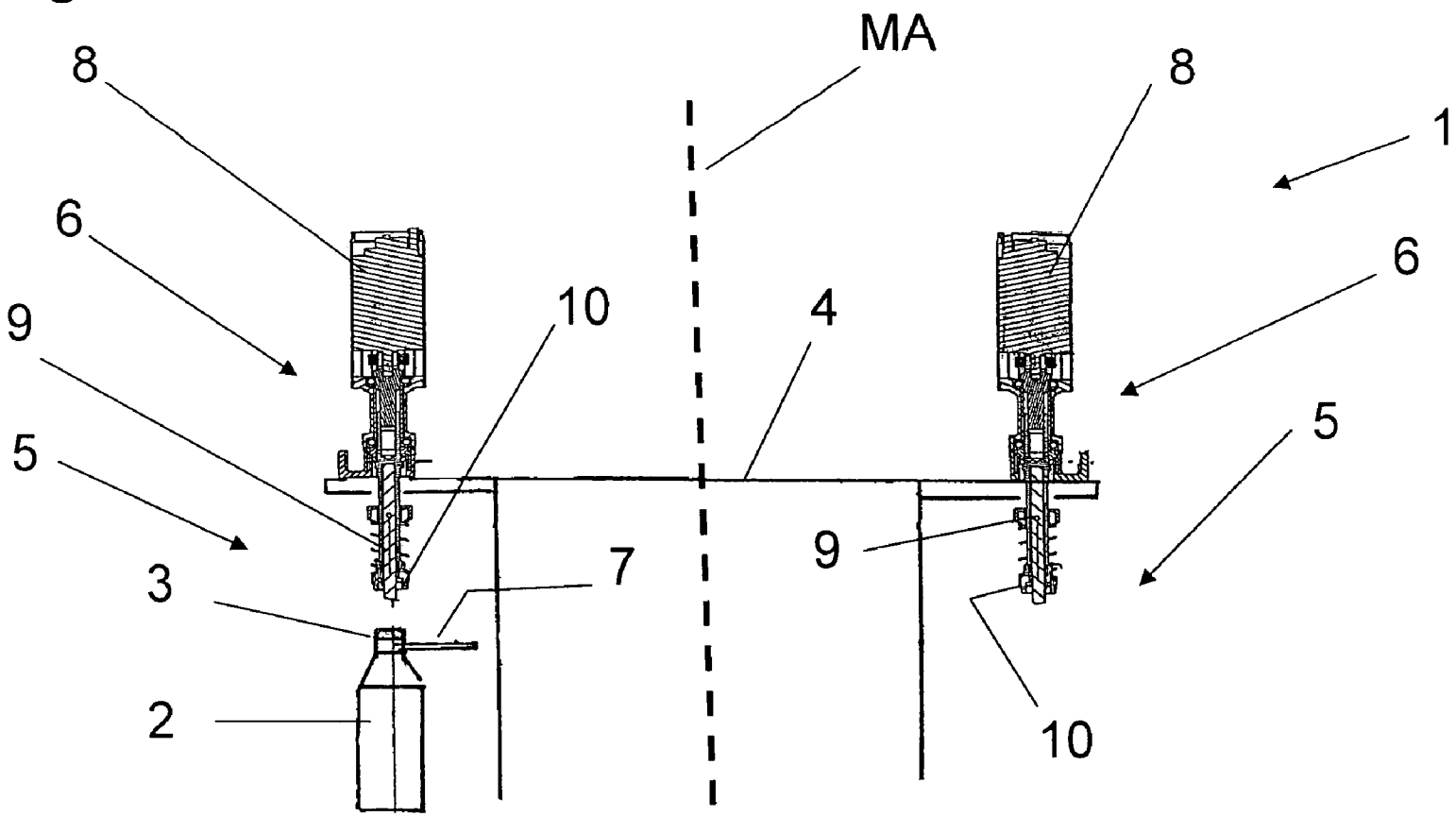
FIG. 1 a simplified view of a container closure machine of the common type for closing bottles or similar containers with container closures in the form of cap-like screw closures.

The container closure machine designated generally as 1 in FIG. 1 of a common type serves for closing bottles 2 with cap-like screw closures 3 which are made for example from one piece of plastic with a base 3.1, a cap edge 3.2 and fluting 3.2.1 on the cap edge 3.2. This external fluting 3.2.1 usually corresponds to the inner contouring 21 of an individual head piece 16.

The container closure machine 1 in the manner known to the skilled person comprises a rotor 4 that can be driven circulating about a vertical machine axis MA, on the periphery of which rotor are formed several closure stations 5 etc. each with a closure tool 6 in the form of a closure screw and each with a container carrier 7 for suspended mounting of the respective bottle 2. The closure tools 6 of the closure stations 5 essentially each comprise an electric motor drive 8, a spindle 9 which is oriented with its axis parallel to the vertical machine axis and which with its upper end is connected driven with the drive 8 or with the motor shaft of this drive 8, and a closure head 10 provided at the lower end and sprung axially. When the rotor 4 rotates, this head picks up the respective screw closure 3 at a cap delivery position not shown, then by raising the respective bottle 2 places it with the bottle neck against the closure head 10 and then the closure head 10, driven rotating about its axis VA via the drive 8 and the spindle, screws the closure onto the respective bottle 2 or onto an external thread provided in the area of the bottle neck, as is also known to the specialist. Naturally the specialist is also aware of central mechanical drives for the closure device and drives mechanically derived therefrom for the spindles 9 or devices with which the closure head 10 is lowered onto a standing or suspended bottle.

Figure 2:
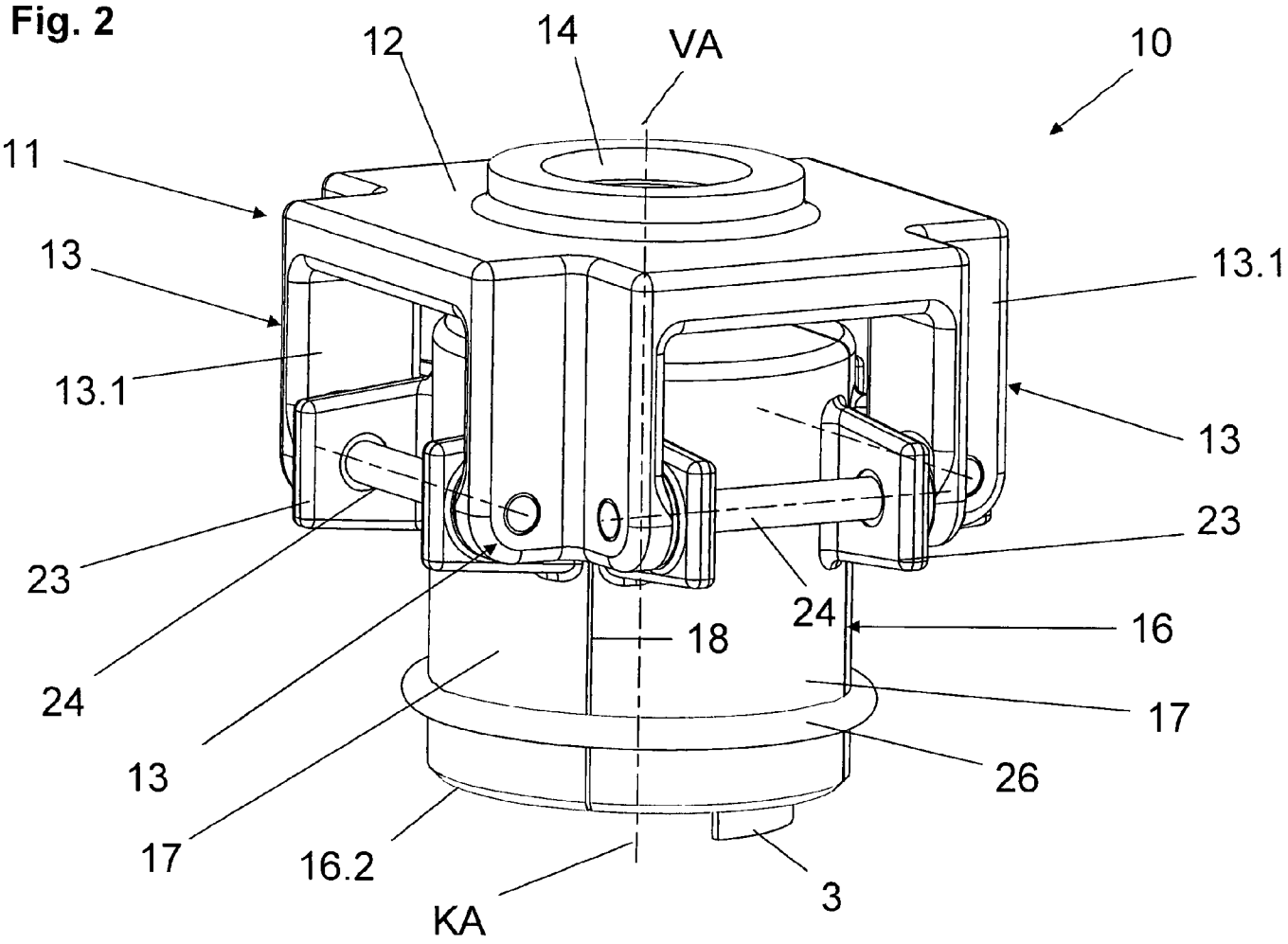
FIG. 2 in perspective individual view, the closure head of a closure tool or screw closure of the container closure machine in FIG. 1.
Figure 3:
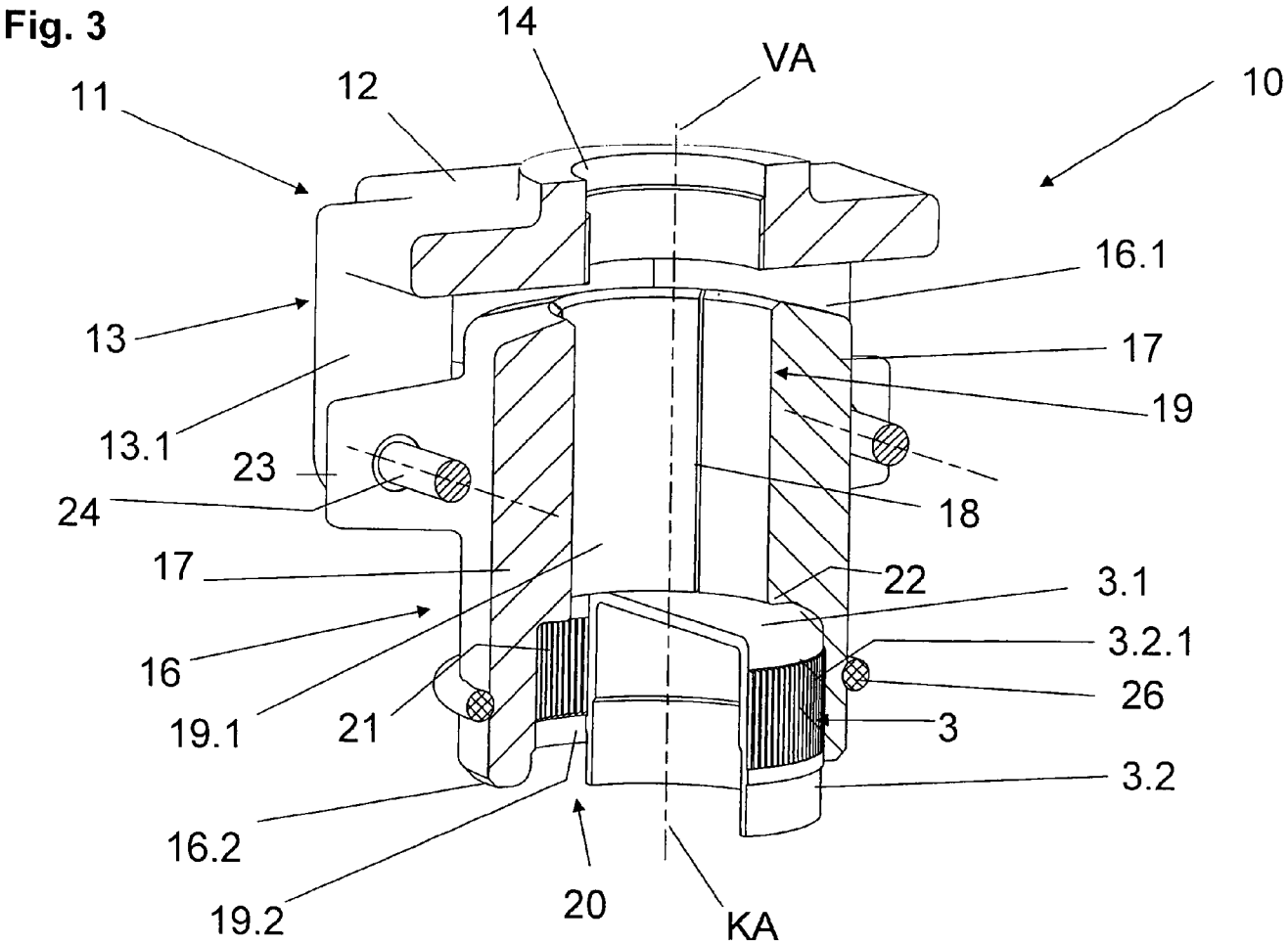
FIG. 3 the closure head of FIG. 2 in perspective individual view and in cross section, together the screw cap also shown in cross section.
Figure 4:
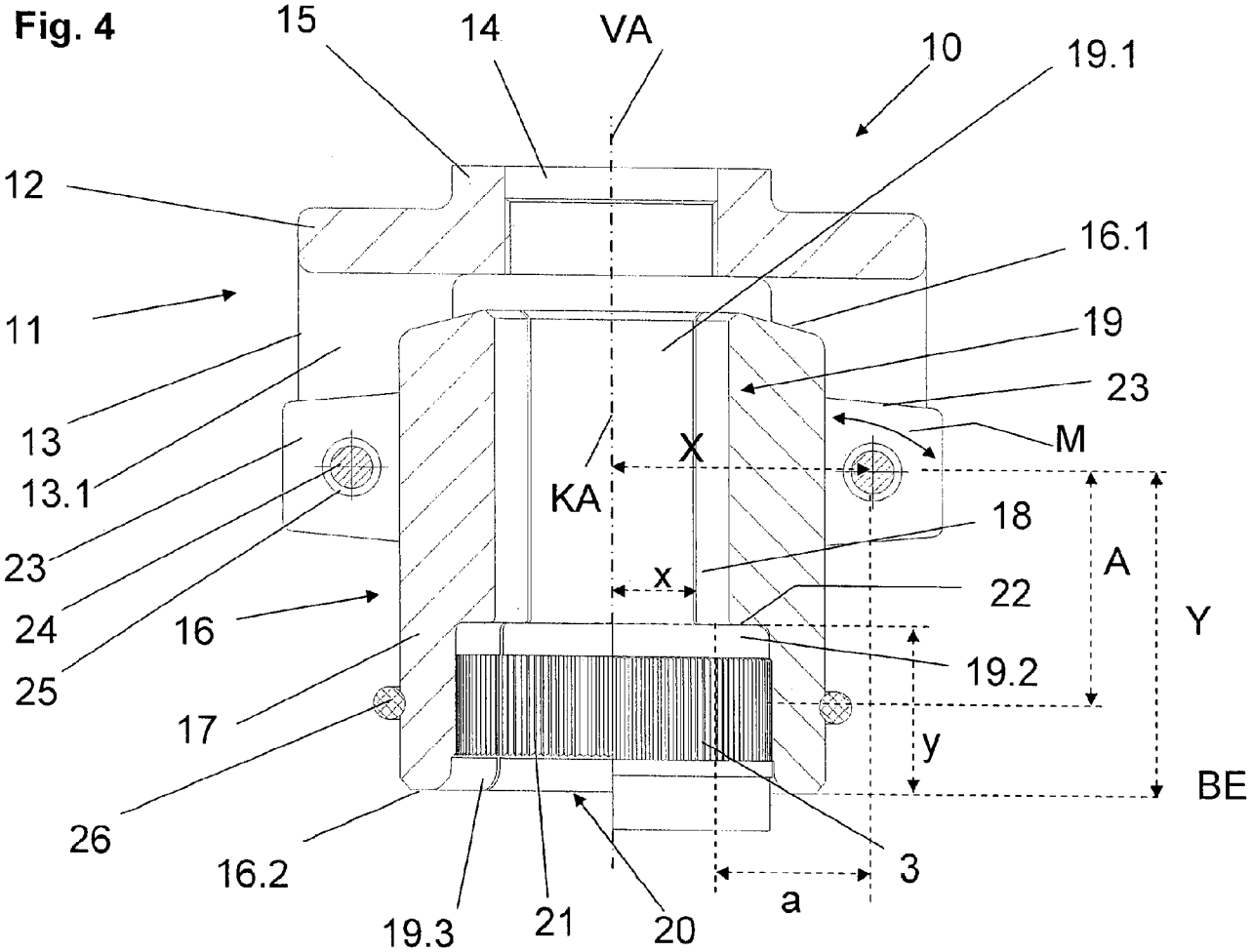
FIG. 4 the closure head in vertical section together with a partial depiction of a screw cap.

As shown in particular from FIGS. 2 to 4, each closure head 10 comprises amongst others a bearing element or a closure head base 11 which is provided at the lower end of the spindle 9 or spindle section, sprung mobile in the axial direction of the spindle 9, or connected driven with the spindle 9. The closure head 10, with its closure head axis VA coaxial to the spindle axis, is attached to the spindle 9.

The closure head base 11 is made as a moulding from a suitable material, for example a metallic material, as one piece with an upper plate-like base section 12 which in the embodiment shown in top view has a substantially square form, and has four corner posts 13 each provided on a corner area of the section 12 and protruding beyond a common underside of the base section 12. The corner posts 13 are each produced as an angle piece with two legs 13.1 which are arranged at least with their external surface sides facing away from each other in planes parallel to the axis VA and perpendicular to the top and bottom of the base section 12 and also perpendicular to any peripheral side of this base section 12.

The two legs 13.1 of each corner post 13 enclose together, on their surface sides facing towards each other, an angle of 90° which open towards the periphery of the closure head 10 or closure head base 11. In a variant not shown, the posts are not designed as angle pieces with two legs but as fingers or columns so that each finger or each column serves as a receptacle and/or mount for one or two joints. The closure head base 11 is furthermore formed with an opening 14 in the centre of the base section 12 which serves to fix the closure head 10 to the spindle 9 and on the inside is fitted with a suitable connecting means, for example an internal thread. To reinforce the closure head base 11 in the area of the opening 14, the base section 12 on its top is formed as one piece with the ring-like protrusion 15 surrounding the opening 14.

Each closure head 10 furthermore comprises a sleeve-like head piece 16 which serves to hold the screw cap 3 and to screw this cap 3 onto the respective bottle 2 to be sealed. The sleeve-like head piece 16 in the embodiment shown is formed from a total of four segments 17 which supplement each other to form the sleeve-like head piece 16 and to these are connected adjacent surfaces 18 which lie in a plane oriented radially or substantially towards the axis KA of the sleeve-like head piece 16.

The head piece 16 on the inside forms an opening 19 which is open at the upper end 16.1 of the head piece 16 adjacent to the underside of the base section 12 but spaced slightly therefrom and at the lower end 16.2 of the head piece 16 facing away from the base section 12. At least when there is no screw cap 3 in the closure head 10 or head piece 16, the segments 17 in the area of the lower end 16.2 of the head piece 16 lie against each other with surfaces 18 so that the axis KA of the head piece 16 formed by the axis of opening 19 coincides with axis VA, and the inner surface of the opening 19 both in the upper opening section 19.1 and in a lower section 19.2 is formed circular cylindrical or substantially circular cylindrical.

The internal diameter of the opening section 19.1 in the embodiment shown is slightly larger than the internal diameter of the opening 14. The internal diameter of the opening section 19.2 is slightly larger than the internal diameter of the opening section 19.1. The opening section 19.1 forms the receptacle 20 to receive and hold a screw cap 3 by clamping. With head piece 16 empty i.e. with no screw cap 3 in the receptacle 20, the internal diameter of the opening section 19.2 is therefore slightly smaller than the outer diameter of the cap-like screw closure 3.

At the inner surface forming a radial contact surface 21 for the screw caps 3, the opening section 19.2 is fitted with fluting which corresponds to the fluting 3.2.1 on the periphery or cap edge 3.2 of the screw closure 3, so that each screw cap 3 held in the receptacle 20 with its fluting 3.1 engages in the fluting of the contact surface 21.

To facilitate the introduction of the screw cap 3 into the head piece 16 or receptacle 20, the head piece 16 and the segments 17 forming this head piece are designed with a rounded face at the lower end 16.2. Furthermore at the lower end 16.2, the opening section 19.2 transforms into a slightly larger diameter opening section 19.3, which then forms the lower open end of the opening 19 or receptacle 20.

The step-like transition between the opening sections 19.1 and 19.2 in the opening 19 forms an annular axial contact surface 22 against which the screw cap 3 held in the receptacle 20 rests with its base 3.1 during closure, whereby a clear axial positioning of each screw cap 3 in the receptacle 20 is achieved.

The segments 17 are each fitted with two retaining arms 23 formed as tabs or lugs which protrude over the outer surface of these segments or the head piece 16 in the embodiment shown, such that the two retaining arms 23 are offset to each other in an axial direction tangential to the circle concentrically surrounding the axis KA, and each retaining arm 23 is in an area of the surface 18, and substantially closer to the top 16.1 of the head piece 16 than the bottom 16.2 of the head piece. Using bearing bolts 24 which extend through bearing bores 25 into the retaining arms 23 and are each held at both ends on one of the corner posts 13, the segments 17 are connected pivoting with the closure head base 11.

In detail the bearing bolts 24 extend between two corner posts 13 and are oriented with their axis parallel to one side of the substantially square base section 12 of the closure head base 11 and hence tangential to a circle line concentrically surrounding axes VA and KA so that segments 17, at least at the lower end 16.2 of the head piece 16, can be swivelled about the axis of the respective hinge bolt 24 radially outward and inward in relation to axis KA. With their sides facing away from each other, the retaining arms 23 each rest against a leg 13.1 of the corner post 13 concerned so that the segments 17 are held on the hinge bolts 24 immobile in the axial direction of the hinge bolts 24.

In the area of the lower end 16.2 on the outer surface of the head piece 16 is provided an annular spring element 26 concentrically surrounding axis KA, which element for axial fixing engages in a ring groove on the outer surface of the head piece 16 and in the embodiment shown of an O-ring is formed from a rubber elastic material. With this spring element 26 the segments 17 are pretensioned sprung radially inwards in relation to axis KA to fix the screw cap 3 in the receptacle 20.

The segments 17 including their retaining arms 23 are each made identically of a suitable material, for example a metal or suitable plastic, so that the closure head 10 is formed mirror- and rotationally symmetrical in all planes enclosing the axis VA and KA and oriented perpendicular to the peripheral sides of the sealing head base 11. Naturally asymmetrical embodiments are also conceivable or embodiments in which at least one segment 17 is not mounted suspended but is rigidly connected with the closure head base 11, in particular the base section 12.

As FIG. 4 in particular shows, the swivel axis of each segment 17 formed by the respective hinge bolt 24 has a radial distance X from the axis VA and/or KA which is greater than the maximum radial distance x between the contact surface 22 formed axially on this segment 17 and the axis VA and/or KA. This means that due to pressure forces F acting on the contact surface 22 via a screw cap 3 held in receptacle 20, moments M about the axis of the pivot bolts 24 result which act in the sense of closing the head piece 16 i.e. in the sense of swivelling the segments 17 radially inwards so that the screw cap 3 concerned is held even more securely in the receptacle 20 by clamping.

When the screw cap 3 concerned is picked up, this is introduced into the receptacle 20 with a slight opening of the head piece 20 i.e. a slight swivel of segment 17 at the lower end 16.2 against the action of spring element 26, and held clamped in this receptacle by the action of the spring element 26. The base 3.1 lying against the contact surface 22 puts this screw cap 3 in the receptacle 20 in a specified position in which this screw cap protrudes with its lower open edge area beyond the underside 16.1. After the screw cap 3 has been placed on the mouth area of a bottle 2, the bottle 2 is pressed with force F of for example 20 kp or around 200N against the screw cap 3 so that due to this force F, via each segment 17 an additional radial clamping force F' is exerted on the cap 3 held in the receptacle 20. The size of the clamping force F' arises from the force F and the translation ratio of the lever arms a and A.

Thus the lever arm a is the mean active distance of the axial contact surface 22 from the axis of the associated pivot bolt 24, and lever arm A is the mean active distance of the radial contact surface 21 from the axis of this mounting bolt 24.

It is therefore possible, depending on the individual closure and the necessary closure force, to adjust or vary the clamping force in the desired manner by changing the lever arms or lever arm ratio a to A and/or y to Y.

After screwing the screw cap 3 onto the respective bottle 2, by the elimination of force F and the additional contact force F' due to lowering of the bottle 2 from the closure head 10 and/or by raising the closure head 10 from the bottle 2, the closure head 10 can easily be separated from the screw cap 3 screwed onto the bottle 2.

As FIG. 4 also shows, the distance Y of each hinge bolt 24 from a reference plane BE oriented perpendicular to axis KA and enclosing the open side of the receptacle 2 is greater than the distance y of the axial contact surface 22 from this reference plane BE.

In particular due to the arrangement of the swivel axes of segments 17 formed by the bearing bolts 24 in relation to the axial contact surface 22, the closure head 10 offers the advantage of achieving a reliable clamping of the respective screw cap 3 due to the additional radial clamping force F' even at greater tolerances also of the diameter of the screw cap 3. Such tolerances are for example due to an uncontrollable or only partly controllable shrinkage of plastic screw caps 3 and/or an ink application not controllable or only partly controllable in thickness onto the screw cap 3.

In an embodiment not shown it is provided that the hinge bolts 24 lie in a plane which intersects the segments 17 in the middle or below the middle, and this plane stands perpendicular to axis KA. In such a case it can be advantageous that instead of the spring element 26 applied from the outside at the lower end onto the segment 17, one or more spreading spring elements are arranged on the upper end. As will be evident to the skilled person, in such embodiment variants some of the lever arm ratios described above deviate depending on the desired force effect or must be adapted accordingly.

The invention has been described above with reference to one embodiment example. It is evident that numerous changes and derivations are possible without leaving the inventive concept on which the invention is based.

It has been assumed above that the head piece 16 has a total of four displaceable segments 17 provided swivelling on the closure head base 11. The number of displaceable segments 17 may also differ from this. Thus for example two or three or more than four segments 17 can be provided which are then each swivellable about axes arranged in a common plane tangential to the circle line surrounding concentrically the closure head axis VA.

REFERENCE NUMERAL LIST

1 Container closure machine
2 Bottle
3 Cap-like screw closure
3.1 Base of screw closure
3.2 Cap edge of screw closure
3.2.1 Fluting
4 Rotor
5 Closure station
6 Closure tool
7 Container carrier
8 Drive
9 Spindle
10 Closure head
11 Closure head base
12 Base section
13 Corner posts
13.1 Leg
14 Fixing opening
15 Annular protrusion
16 Head piece
16.1 Top of head piece 16
16.2 Bottom of head piece
17 Segment of head piece 16
18 Surface
19 Head piece opening
19.1-19.3 Opening section
20 Receptacle
21 Radial contact surface with fluting
22 Axial contact surface
23 Retaining arm
24 Hinge bolts
25 Bearing bore
26 Spring element
a, A Lever arm
x, X Radial distance
y, Y Axial distance
F Axial contact force
F' Radial contact force
M Moment
BE Reference plane
KA Axis of head piece 16
VA Axis of closure head 10

The invention claimed is:

1. An apparatus for closing containers with closures, said apparatus comprising a closure head, said closure head including: a head piece forming a receptacle for holding a closure therein, the receptacle being formed on the head piece and open on an underside of the closure head and head piece, wherein the receptacle, in relation to an axis thereof, forms at least one radial contact surface and at least one axial contact surface for the closure held in the receptacle, wherein the radial contact surface, for at least a force fit holding of the closure in the receptacle, is formed at least partly by at least a first moveable segment that, at least in an area of the radial contact surface, is mobile at least radial to the axis of the receptacle, wherein the axial contact surface is provided at least partly on at least the first moveable segment, and wherein at least the first moveable segment is guided or mounted on a closure head base such that a pressure force exerted on the at least one axial contact surface causes a clamping force of the movable segment, the clamping force acting radially inward in relation to the axis of the receptacle.

2. The apparatus of claim 1, wherein the head piece further comprises at least a second movable segment, and wherein at least two moveable segments form the receptacle.

3. The apparatus of claim 1, wherein the head piece further comprises at least second, third, and fourth moveable segments.

4. The apparatus of claim 1, further comprising a second movable segment, wherein at least the first and second movable segments supplement each other into a sleeve-like head piece with a sleeve opening open on a head piece underside and on a head piece upper side, the receptacle for the at least one closure being formed by a first opening section of the sleeve opening that has a larger cross section than and that connects to a second opening section of reduced cross section at an upper end of the head piece, wherein the radial contact surface is formed by the inner surface of the first opening section, wherein the axial contact surface is formed by a step-like transition between the first and second opening sections.

5. The apparatus of claim 1, wherein at least the first moveable segment is held on the closure head base about at least one swivel axis perpendicular to the axis of the receptacle.

6. The apparatus of claim 5, wherein the swivel axis of the at least one moveable segment has a radial distance from the axis of the receptacle that is greater than a radial distance of the axial contact surface from the axis.

7. The apparatus of claim 1, wherein the at least the first movable segment comprises at least two retaining arms that are spaced apart and that protrude beyond an outer surface of the segment, and with which the segment is held swivelably on the closure head base.

8. The apparatus of claim 1, wherein the closure head base comprises: a base section fixable to a closure tool, and at least two bearing elements protruding over an underside of the base section facing the head piece, wherein at least the first moveable segment is swivelably mounted between the at least two bearing elements.

9. The apparatus of claim 8, wherein the base section is formed with several bearing elements that are provided at the same radial distance from the axis of the receptacle, said bearing elements being distributed at even angular spacing about the axis, wherein at least the first moveable segment is swivelably mounted between two adjacent bearing sections of bearing elements.

10. The apparatus of claim 1, further comprising multiple additional movable segments, wherein at least the first moveable segment and the multiple additional movable segments are formed identically.

11. The apparatus of claim 1, further comprising spring means for pre-tensioning the at least one movable segment in a radial inner position.

12. The apparatus of claim 11, wherein the spring means is disposed in an area of an underside of the head piece and wherein the spring means is applied to or acts upon the at least one movable segment.

13. The apparatus of claim 12, wherein the spring means comprises an O-ring.

14. The apparatus of claim 11, wherein the spring means is arranged in the vicinity of a top of the head piece, and wherein the spring means is mounted or acts in a spreading fashion on at least the first movable segment.

15. The apparatus of claim 1, wherein the receptable is configured to hold screw caps.

16. The apparatus of claim 1, further comprising a container closure machine for closing containers with closures, at one or more closure stations thereof, each of said closure stations having at least one closure tool with a closure head forming a recess for one closure, the closure head having the structure recited in claim 1.

17. The apparatus of claim 16, further comprising a rotor that can be driven to rotate about a vertical machine axis of the closure machine, and wherein said closure stations are formed on said rotor, each of said stations comprising at least one closure tool with a closure head forming a receptacle for one closure, said closure head having the structure recited in claim 1.

18. The apparatus of claim 1, wherein the head piece further comprises at least a second and a third moveable segment, and wherein at least three moveable segments form the receptacle.

19. The apparatus of claim 1, wherein the closure head, including its base element and head piece, are designed to have mirror symmetry relative to a plane that includes the axis of the receptacle.

* * * * *